US005142727A

United States Patent [19]

Koester

[11] Patent Number: 5,142,727

[45] Date of Patent: Sep. 1, 1992

[54] CARPET SCRUBBING BONNET

[76] Inventor: James A. Koester, 3195 Wendover, Troy, Mich. 48084

[21] Appl. No.: 783,859

[22] Filed: Oct. 28, 1991

[51] Int. Cl.[5] ..... A47L 11/14

[52] U.S. Cl. ..... 15/230; 15/98; 15/230.16; 428/97

[58] Field of Search ..... 15/4, 49.1, 50.1, 98, 15/180, 114, 208, 209 R, 217, 230, 230.12, 230.14, 230.16, 230.17, 230.19, 385; 428/88, 97

[56] References Cited

U.S. PATENT DOCUMENTS 3,703,739 11/1972 Young et al. ..... 15/230.17
3,728,075 4/1973 Cannan ..... 15/230.17
3,990,124 11/1976 MacKay, Jr. et al. ..... 15/230.12
4,418,438 12/1983 Cutler ..... 15/230
4,961,243 10/1990 Barber ..... 15/230

FOREIGN PATENT DOCUMENTS 2726485 12/1978 Fed. Rep. of Germany .... 15/209 R

*Primary Examiner*—Philip R. Coe
*Assistant Examiner*—Mark Spisich
*Attorney, Agent, or Firm*—Robert G. Mentag

[57] ABSTRACT

A circular carpet scrubbing bonnet having an upper face and a lower face. Each of said bonnet faces being provided with a plurality of carpet cleaning solution absorbent areas which are spaced apart laterally by a plurality of carpet scrubbing fibers disposed in parallel, spaced apart positions.

7 Claims, 1 Drawing Sheet

CARPET SCRUBBING BONNET

BACKGROUND OF THE INVENTION

1. Field of the Invention

The field of art to which this invention pertains may be generally located in the class of devices relating to scrubbing bonnets. Class 15, Brushing, Scrubbing and General Cleaning, United States Patent Office Classification, appears to be the applicable general area of art to which the subject matter similar to this invention has been classified in the past.

2. Description of the Prior Art

This invention relates generally to carpet cleaning bonnets, and more particularly, to a unique carpet cleaning bonnet having built-in brush strips. On-location carpet cleaning comprises a carpet cleaning system which is an alternative to introducing liquid cleaning solutions such as water-base detergents and solvents into a carpet and extracting such liquids. A bonnet cleaning carpet cleaning system is used in hotel lobbies, and similar places where there are high traffic areas, such as in elevators and stairways. The bonnet cleaning system cleans the top of a carpet but a disadvantage of such a system is that it does not go down deep into a carpet to remove stains and soil.

It is a primary object of the present invention to provide a unique carpet bonnet having built-in brush strips which function to clean deeper into a carpet then the prior art bonnets so as to remove stains and soil. Examples of prior art carpet cleaning bonnets are shown in U.S. Pat. Nos. 3,703,739 and 3,728,075.

SUMMARY OF THE INVENTION

The aforegoing object is accomplished by providing a combination carpet cleaning bonnet and brush. The carpet bonnet of the present invention provides two functions. It brushes a carpet to release the dirt and soil and then absorbs the liquid cleaning solution and dirt raised from the carpet and takes it out of the carpet. The carpet bonnet includes a plurality of cleaning solution absorbent areas and a plurality of brush strips which aggressively scrub the cleaning solution into all levels of a carpet, and provide a "like new" carpet appearance to a carpet. The carpet bonnet is adapted for use with standard rotary floor machines. It is a faster, more efficient carpet scrubbing apparatus then the prior art carpet bonnets and it provides a great labor savings while reducing carpet "down time" after cleaning.

DESCRIPTION OF THE PREFERRED EMBODIMENT

Figure 1:
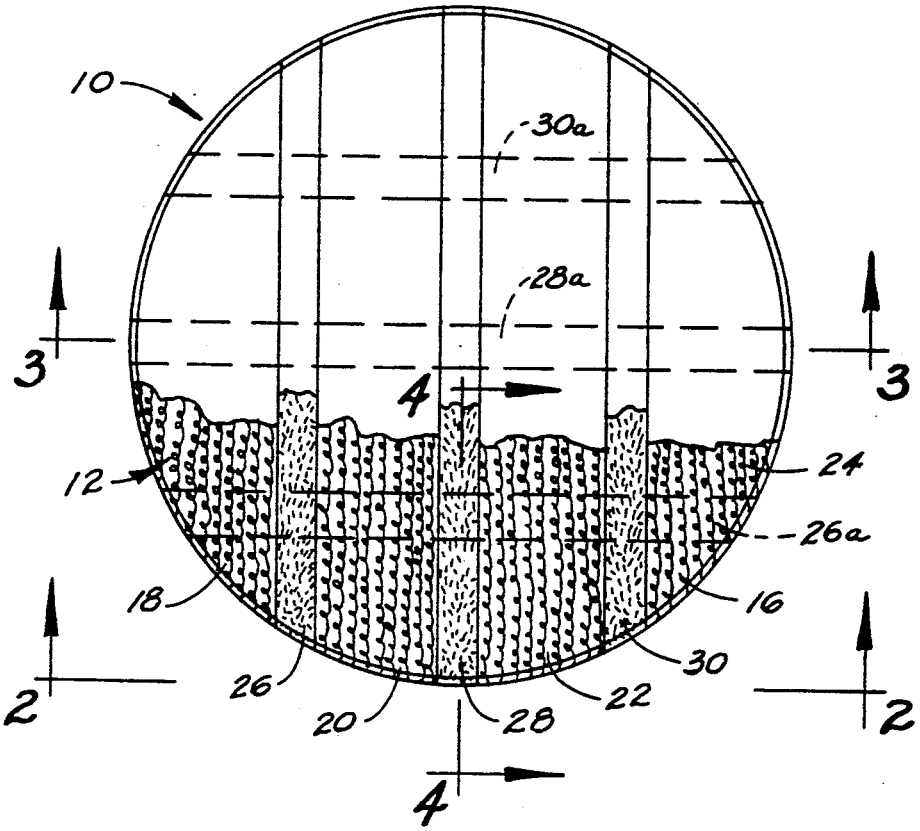
FIG. 1 is a plan view of one face of a carpet bonnet provided with built-in brush strips, and made in accordance with the principles of the present invention.
Figure 2:
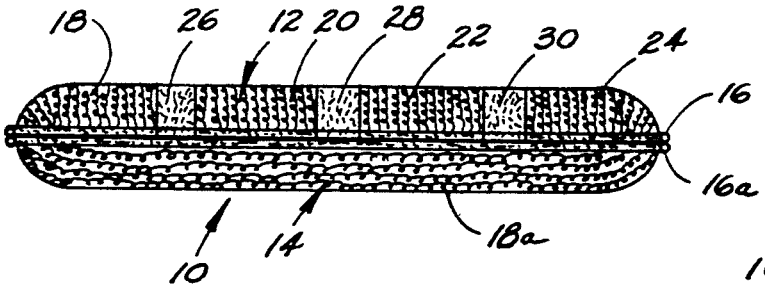
FIG. 2 is a side elevation view of the carpet bonnet shown in FIG. 1, taken along the line 2—2 thereof, and looking in the direction of the arrows.
Figure 3:
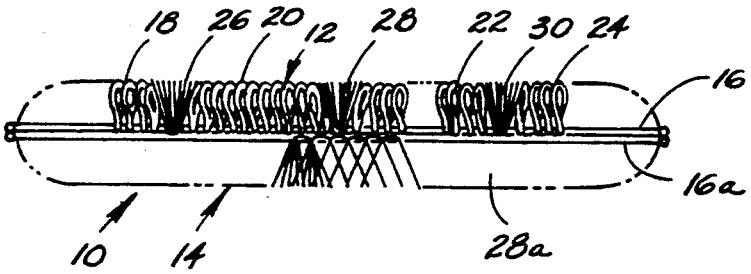
FIG. 3 is an elevation section view of the carpet bonnet shown in FIG. 1, taken along the line 3—3 thereof, and looking in the direction of the arrows.

Referring now to the drawings and in particular to FIGS. 1 and 2, the numeral 10 generally designates a double-faced scrubbing bonnet for cleaning carpets. As shown in FIG. 2, the bonnet 10 comprises a pair of identical bonnet members, generally indicated by the numerals 12 and 14, which have the inner sides thereof adhered together, as more fully explained hereinafter. For purposes of discussion, and as viewed in FIG. 2, the bonnet members 12 and 14 may be termed the upper and lower bonnet members.

As shown in FIGS. 1 and 2, the upper bonnet member 12 includes a circular, polypropylene fabric backing or pad indicated by the numeral 16. The backing or pad 16 is needle punched and has tufted thereinto a plurality of laterally spaced apart cleaning solution absorbent areas indicated by the numerals 18, 20, 22 and 24. The cleaning solution absorbent areas 18, 20, 22 and 24 are formed by tufting a fluid absorbent material into the needle punched polypropylene backing or pad 16. The polypropylene backing or pad 16 may be of any suitable thickness, as for example what is known as a 12 ounce thickness. The cleaning solution absorbent material used in making the absorbent areas 18, 20, 22 and 24 may be of any suitable type. A preferable cleaning solution absorbent material is a viscose/polyester combination yarn, available on the market under the trademark "TURAN" yarn. This yarn is tufted into the needle punched polypropylene backing or pad 16 by a tufting machine available on the market from the Broad Street Machine Company of 2614 South Broad Street, Chattanooga, Tenn. 27409, and sold under Model No. 30—30.

The carpet bonnet 10 includes three parallel, spaced apart, scrubbing brush areas in the form of fiber strips, designated by the numerals 26, 28 and 30. The scrubbing brush strip 26 is disposed between the cleaning solution absorbent areas 18 and 20. The scrubbing brush fiber strip 28 is disposed between the cleaning solution absorbent areas 20 and 22. The scrubbing brush fiber strip 30 is disposed between the cleaning solution absorbent areas 22 and 24. The scrubbing brush fiber strips 26, 28 and 30 are formed by a plurality of polypropylene monofilament fibers, which are tufted into the needle punched polypropylene backing or pad 16, by the aforedescribed tufting machine Model 30—30. In one embodiment the depth of the brush fibers extended upwardly from the backing or pad 16 approximately ½ an inch. A preferable range of length for the scrubbing fibers is from about ½ of an inch to ¾ of an inch. The depth of the loops of cleaning solution absorbent yarn in the cleaning solution areas 18, 20, 22 and 24 are of a depth or length substantially equal to the fibers comprising the scrubbing brush fiber strips 26, 28 and 30. In one embodiment the scrubbing brush fiber strips 26, 28 and 30 were formed by three rows of laterally spaced apart needle holes, which were spaced apart lengthwise of each strip at a gage of about 5/32 of an inch, and filled with fiber tufts.

Figure 4:
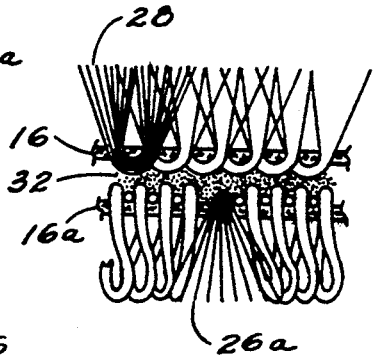
FIG. 4 is a fragmentary, elevation section view of the carpet bonnet shown in FIG. 1, taken along the line 4—4 thereof, and looking in the direction of the arrows.

As illustrated in FIG. 4, the polypropylene monofilament fiber tufts forming the scrubbing brush strips 26, 29 and 30 are held in place by a polypropylene hot melt adhesive applied onto the fiber tufts on the inner side of the bonnet fabric backing or pad 16.

The lower bonnet member 14 of the carpet scrubbing bonnet 10 is formed from an identical structure as described for the upper bonnet member 12, and the identical portions of the lower bonnet member 14 have been marked with the same reference numerals as used on the upper bonnet member 12, followed by the small letter "a". In the embodiment shown in FIGS. 1 thru 4, the bonnet lower member 14 is positioned or turned 90 degrees from the position of the upper bonnet member 12, so as to have the scrubbing brush fiber strips 26*a*, 28*a* and 30*a* disposed in positions 90 degrees relative to the scrubbing brush fiber strips 26, 28 and 30 in the upper bonnet member 12. The upper bonnet member 12 is fixedly secured to the lower bonnet member 14 by stitching 34 (FIG. 1) around the outer periphery of the fabric backing or pads 16 and 16*a*.

In use, the scrubbing bonnet 14 is operated by a conventional rotary machine having a rotating disc which applies pressure and rotates the pad 10 against the surface of a carpet being cleaned. A machine of this type is illustrated in the aforementioned U.S. Pat. No. 3,728,075. The cleaning solution can be applied to the carpet by said machine, or by manually putting the cleaning solution on a carpet before operating the carpet scrubbing bonnet 10 on a carpet. The carpet scrubbing bonnet 10 applies a scrubbing, brushing action, by means of the scrubbing strips 26, 28 and 30, to a carpet to release dirt and soil therefrom, after which the cleaning solution absorbs the dirt and soil and lifts it from the carpet. The cleaning solution, with the soil and dirt, is removed from a carpet by absorbent areas 18, 20, 22 and 24. The cleaning action of the carpet scrubbing bonnet 10 works deeper into a carpet then the prior art cleaning bonnets, to remove stains and soil, and such deep cleaning action is not possible by the use of the prior art bonnets. The upper and lower bonnet members 12 and 4 would be used successively, after which the bonnet 10 would be cleaned for re-use.

What is claimed is:

1. A carpet cleaning bonnet comprising:

(a) a backing member comprising a circular fabric pad;

(b) a plurality of spaced apart cleaning solution absorbent areas formed on said backing member;

(c) a plurality spaced apart, scrubbing brush areas, formed on said backing member between said cleaning solution absorbent areas;

(d) said cleaning solution absorbent areas being spaced apart across the diameter of the backing member by means of the scrubbing brush areas; and, (e) said scrubbing brush areas comprises brush fibers disposed in parallel strips on the backing member and extending completely across the backing member, between the cleaning solution absorbent areas.

2. A carpet cleaning bonnet as defined in claim 1, wherein:

(a) said brush fibers are secured to the circular fabric pad by an adhesive.

3. A carpet cleaning bonnet as defined in claim 2, wherein:

(a) the adhesive securing the brush fibers to the fabric pad is a hot melt adhesive applied onto the fibers on an inner side of the bonnet pad.

4. A carpet cleaning bonnet as defined in claim 3, wherein:

(a) the cleaning solution absorbent areas are formed by tufting an absorbent yarn into the bonnet pad.

5. A carpet cleaning bonnet as defined in claim 4, wherein:

(a) said absorbent yarn comprises a blend of viscose and polyester.

6. A carpet cleaning bonnet as defined in claim 5, wherein:

(a) said bonnet pad comprises a polypropylene backing.

7. A carpet cleaning bonnet as defined in claim 6, wherein:

(a) said scrubbing brush fibers comprise polypropylene monofilament fibers tufted into the polypropylene backing.

* * * * *